US009605567B2

(12) United States Patent
Karnjate et al.

(10) Patent No.: US 9,605,567 B2
(45) Date of Patent: Mar. 28, 2017

(54) OIL PUMP CONTROL SYSTEMS AND METHODS

(71) Applicant: GM Global Technology Operations LLC, Detroit, MI (US)

(72) Inventors: Timothy M. Karnjate, Grand Blanc, MI (US); David R. Staley, Flushing, MI (US); Mike M. McDonald, Macomb, MI (US); Gregory J. York, Fenton, MI (US)

(73) Assignee: GM Global Technology Operations LLC, Detroit, MI (US)

( * ) Notice: Subject to any disclaimer, the term of this patent is extended or adjusted under 35 U.S.C. 154(b) by 434 days.

(21) Appl. No.: 14/329,038

(22) Filed: Jul. 11, 2014

(65) Prior Publication Data

US 2015/0354419 A1 Dec. 10, 2015

Related U.S. Application Data

(60) Provisional application No. 62/007,613, filed on Jun. 4, 2014.

(51) Int. Cl.
*F01M 1/16* (2006.01)
*F01M 1/02* (2006.01)

(52) U.S. Cl.
CPC ..... *F01M 1/16* (2013.01); *F01M 1/02* (2013.01); *F01M 2250/60* (2013.01)

(58) Field of Classification Search
CPC ..... F01M 1/16; F01M 1/02; F01M 2250/00; F01M 2250/60; F01M 2250/62; F01M 2250/64; F01M 2250/66
See application file for complete search history.

(56) References Cited

U.S. PATENT DOCUMENTS

2004/0187835 A1* 9/2004 Hoff ..... F01M 1/16 123/196 R
2016/0222843 A1* 8/2016 Koguchi ..... F01M 1/16

* cited by examiner

*Primary Examiner* — Jacob Amick

(57) ABSTRACT

A first target module determines a first target output pressure of an engine oil pump based on a speed of the engine oil pump and an oil temperature. A second target module, based on a runtime period of an engine, sets a second target output pressure of the engine oil pump to one of greater than and equal to the first target output pressure. A third target module, based on an engine load, sets a third target output pressure of the engine oil pump to one of greater than and equal to the first target output pressure. A selection module selects one of the second and third target output pressures, sets a selected target output pressure based on the selected one of the second and third target output pressures, and controls displacement of the engine oil pump based on the selected target output pressure.

20 Claims, 4 Drawing Sheets

OIL PUMP CONTROL SYSTEMS AND METHODS

CROSS-REFERENCE TO RELATED APPLICATIONS

This application claims the benefit of U.S. Provisional Application No. 62/007,613, filed on Jun. 4, 2014. The disclosure of the above application is incorporated herein by reference in its entirety.

FIELD

The present disclosure relates to internal combustion engines and more particularly to control systems and methods for engine oil pumps.

BACKGROUND

The background description provided here is for the purpose of generally presenting the context of the disclosure. Work of the presently named inventors, to the extent it is described in this background section, as well as aspects of the description that may not otherwise qualify as prior art at the time of filing, are neither expressly nor impliedly admitted as prior art against the present disclosure.

Internal combustion engines combust an air and fuel mixture within cylinders to generate drive torque. Air flow into gasoline engines may be regulated via a throttle valve. The throttle regulates airflow into the engine. Fuel injectors provide the fuel. In some types of engines, such as gasoline engines, spark plugs may initiate combustion.

The engine includes an oil reservoir. An oil pump draws oil from the oil reservoir and pumps the oil to various locations within the engine. The engine oil lubricates components of the engine and serves other functions. Examples of oil pumps include mechanical oil pumps, electrical oil pumps, and electro-mechanical oil pumps. Some types of oil pumps are variable displacement oil pumps and can vary the rate at which they output oil.

SUMMARY

In a feature, an engine oil pump control system is disclosed. A first target module determines a first target output pressure of an engine oil pump based on a speed of the engine oil pump and an oil temperature. A second target module, based on a runtime period of an engine, sets a second target output pressure of the engine oil pump to one of greater than and equal to the first target output pressure. A third target module, based on an engine load, sets a third target output pressure of the engine oil pump to one of greater than and equal to the first target output pressure. A selection module selects one of the second and third target output pressures, sets a selected target output pressure based on the selected one of the second and third target output pressures, and controls displacement of the engine oil pump based on the selected target output pressure.

In further features, an adjustment module determines an adjustment value based on the runtime period of the engine, and the second target module determines the second target output pressure of the engine oil pump as a function of the first target output pressure and the adjustment value.

In still further features, an adjustment module determines an adjustment value based on the engine load, and the second target module determines the second target output pressure of the engine oil pump as a function of the first target output pressure and the adjustment value.

In yet further features, the selection module selects the second target output pressure when the second target output pressure is greater than the third target output pressure.

In further features, the selection module selects the third target output pressure when the third target output pressure is greater than the second target output pressure.

In still further features: a proportional module determines a proportional pressure adjustment based on a proportional gain value and a difference between an engine oil pressure and the selected target output pressure; an integral module determines an integral pressure adjustment based on an integral gain value and the difference between the engine oil pressure and the selected target output pressure; and a target duty cycle module selectively sets a target duty cycle for controlling the displacement of the engine oil pump based on a sum of the selected target output pressure, the proportional pressure adjustment, and the integral pressure adjustment.

In yet further features, the proportional module determines the proportional gain value based on the engine oil pressure.

In yet further features, the proportional module determines the proportional gain value further based on an engine oil temperature.

In further features, the integral module determines the integral gain value based on the engine oil pressure.

In still further features, the integral module determines the integral gain value further based on an engine oil temperature.

In a feature, an engine oil pump control method is disclosed. The engine oil pump control method includes: determining a first target output pressure of an engine oil pump based on an engine speed and an oil temperature; based on a runtime period of an engine, setting a second target output pressure of the engine oil pump to one of greater than and equal to the first target output pressure; based on an engine load, setting a third target output pressure of the engine oil pump to one of greater than and equal to the first target output pressure; selecting one of the second and third target output pressures; setting a selected target output pressure based on the selected one of the second and third target output pressures; and controlling displacement of the engine oil pump based on the selected target output pressure.

In further features, the engine oil pump control method further includes: determining an adjustment value based on the runtime period of the engine; and determining the second target output pressure of the engine oil pump as a function of the first target output pressure and the adjustment value.

In still further features, the engine oil pump control method further includes: determining an adjustment value based on the engine load; and determining the second target output pressure of the engine oil pump as a function of the first target output pressure and the adjustment value.

In yet further features, the engine oil pump control method further includes: selecting the second target output pressure when the second target output pressure is greater than the third target output pressure.

In further features, the engine oil pump control method further includes: selecting the third target output pressure when the third target output pressure is greater than the second target output pressure.

In still further features, the engine oil pump control method further includes: determining a proportional pressure adjustment based on a proportional gain value and a difference between an engine oil pressure and the selected target output pressure; determining an integral pressure adjustment based on an integral gain value and the difference between the engine oil pressure and the selected target output pressure; and selectively setting a target duty cycle for controlling the displacement of the engine oil pump based on a sum of the selected target output pressure, the proportional pressure adjustment, and the integral pressure adjustment.

In yet further features, the engine oil pump control method further includes:

determining the proportional gain value based on the engine oil pressure.

In further features, the engine oil pump control method further includes:

determining the proportional gain value further based on an engine oil temperature.

In still further features, the engine oil pump control method further includes:

determining the integral gain value based on the engine oil pressure.

In yet further features, the engine oil pump control method further includes:

determining the integral gain value further based on an engine oil temperature.

Further areas of applicability of the present disclosure will become apparent from the detailed description, the claims and the drawings. The detailed description and specific examples are intended for purposes of illustration only and are not intended to limit the scope of the disclosure.

BRIEF DESCRIPTION OF THE DRAWINGS

The present disclosure will become more fully understood from the detailed description and the accompanying drawings, wherein.

In the drawings, reference numbers may be reused to identify similar and/or identical elements.

DETAILED DESCRIPTION

A vehicle includes an oil pump that pumps engine oil to various locations within an engine. The engine oil lubricates components of the engine and serves other functions. A pump control module controls a displacement of the oil pump. As the oil pump is driven by the engine, such as by the crankshaft, the displacement of the oil pump can be reduced under some circumstances to decrease a torque load on the engine imposed by the oil pump.

The pump control module determines a minimum target output pressure of the oil pump based on a speed of the engine and a temperature of the engine oil. The pump control module determines a first target output pressure of the oil pump based on the minimum target output pressure and a first adjustment value determined based on a period that the engine has been running. The pump control module also determines a second target output pressure of the oil pump based on the minimum target output pressure and a second adjustment value determined based on an engine load.

The pump control module selects a highest target output pressure and controls the oil pump based on the selected target output pressure. This ensures that the oil pump outputs oil to achieve the highest one of the target output pressures and that displacement of the oil pump is reduced when higher displacement is not needed.

Figure 1:
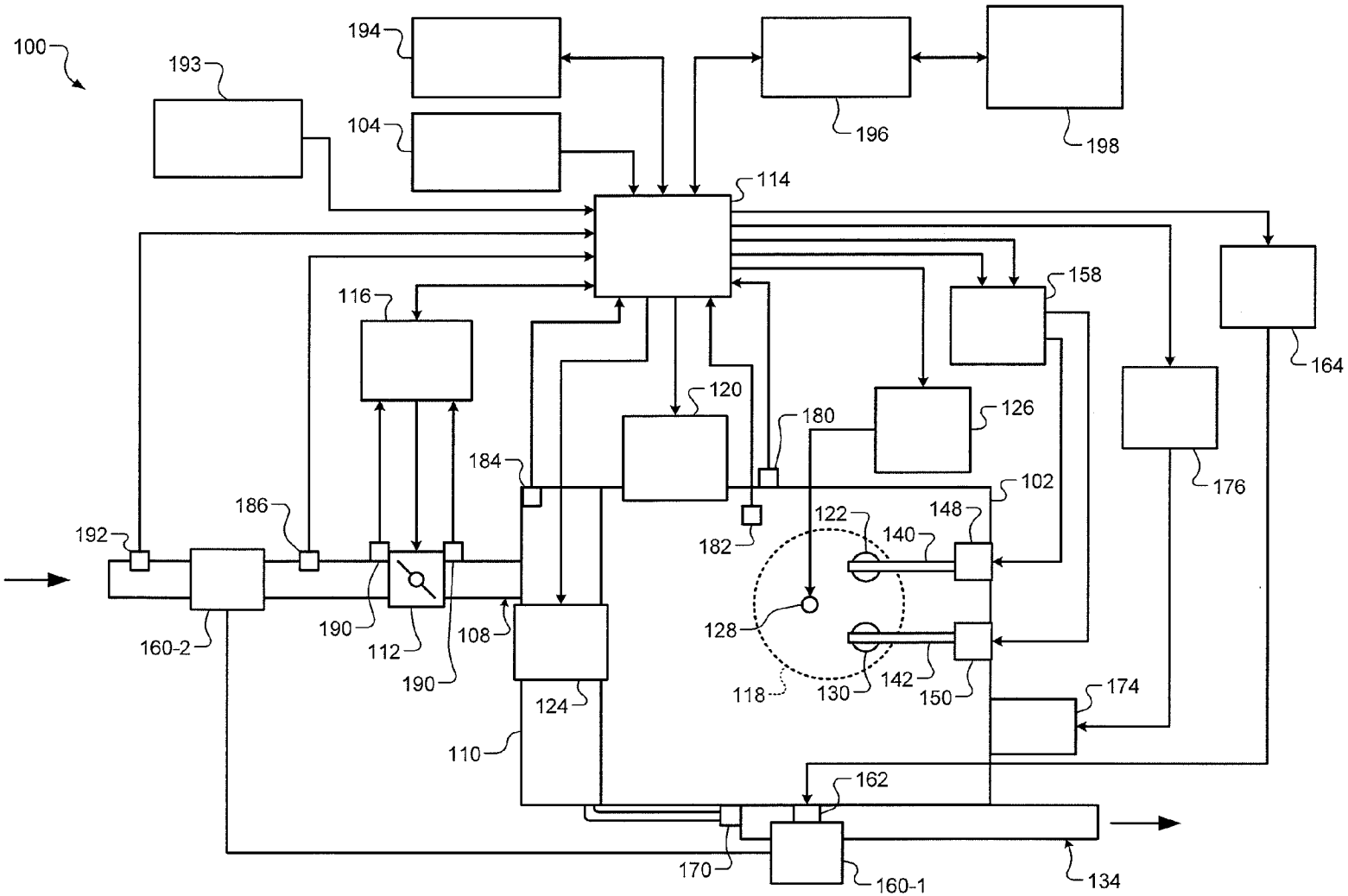
FIG. 1 is a functional block diagram of an example engine system.

Referring now to FIG. 1, a functional block diagram of an example engine system 100 is presented. The engine system 100 includes an engine 102 that combusts an air/fuel mixture to produce drive torque for a vehicle based on driver input from a driver input module 104. The engine 102 may be a gasoline spark ignition internal combustion engine.

Air is drawn into an intake manifold 110 through a throttle valve 112. For example only, the throttle valve 112 may include a butterfly valve having a rotatable blade. An engine control module (ECM) 114 controls a throttle actuator module 116, which regulates opening of the throttle valve 112 to control the amount of air drawn into the intake manifold 110.

Air from the intake manifold 110 is drawn into cylinders of the engine 102. While the engine 102 may include multiple cylinders, for illustration purposes a single representative cylinder 118 is shown. For example only, the engine 102 may include 2, 3, 4, 5, 6, 8, 10, and/or 12 cylinders. The ECM 114 may instruct a cylinder actuator module 120 to selectively deactivate some of the cylinders, which may improve fuel economy under certain engine operating conditions.

The engine 102 may operate using a four-stroke cycle. The four strokes, described below, may be referred to as the intake stroke, the compression stroke, the combustion stroke, and the exhaust stroke. During each revolution of a crankshaft (not shown), two of the four strokes occur within the cylinder 118. Therefore, two crankshaft revolutions are necessary for the cylinder 118 to experience all four of the strokes.

During the intake stroke, air from the intake manifold 110 is drawn into the cylinder 118 through an intake valve 122. The ECM 114 controls a fuel actuator module 124, which regulates fuel injection to achieve a target air/fuel ratio. Fuel may be injected into the intake manifold 110 at a central location or at multiple locations, such as near the intake valve 122 of each of the cylinders. In various implementations (not shown), fuel may be injected directly into the cylinders or into mixing chambers associated with the cylinders. The fuel actuator module 124 may halt injection of fuel to cylinders that are deactivated.

The injected fuel mixes with air and creates an air/fuel mixture in the cylinder 118. During the compression stroke, a piston (not shown) within the cylinder 118 compresses the air/fuel mixture. A spark actuator module 126 energizes a spark plug 128 in the cylinder 118 based on a signal from the ECM 114, which ignites the air/fuel mixture. The timing of the spark may be specified relative to the time when the piston is at its topmost position, referred to as top dead center (TDC).

The spark actuator module 126 may be controlled by a timing signal specifying how far before or after TDC to generate the spark. Because piston position is directly related to crankshaft rotation, operation of the spark actuator module 126 may be synchronized with crankshaft angle. Generating spark may be referred to as a firing event. The spark actuator module 126 may have the ability to vary the timing of the spark for each firing event. The spark actuator module 126 may vary the spark timing for a next firing event when the spark timing is changed between a last firing event and the next firing event. The spark actuator module 126 may halt provision of spark to deactivated cylinders.

During the combustion stroke, the combustion of the air/fuel mixture drives the piston away from TDC, thereby driving the crankshaft. The combustion stroke may be defined as the time between the piston reaching TDC and the time at which the piston reaches bottom dead center (BDC). During the exhaust stroke, the piston begins moving away from BDC and expels the byproducts of combustion through an exhaust valve 130. The byproducts of combustion are exhausted from the vehicle via an exhaust system 134.

The intake valve 122 may be controlled by an intake camshaft 140, while the exhaust valve 130 may be controlled by an exhaust camshaft 142. In various implementations, multiple intake camshafts (including the intake camshaft 140) may control multiple intake valves (including the intake valve 122) for the cylinder 118 and/or may control the intake valves (including the intake valve 122) of multiple banks of cylinders (including the cylinder 118). Similarly, multiple exhaust camshafts (including the exhaust camshaft 142) may control multiple exhaust valves for the cylinder 118 and/or may control exhaust valves (including the exhaust valve 130) for multiple banks of cylinders (including the cylinder 118). In various other implementations, the intake valve 122 and/or the exhaust valve 130 may be controlled by devices other than camshafts, such as camless valve actuators. The cylinder actuator module 120 may deactivate the cylinder 118 by disabling opening of the intake valve 122 and/or the exhaust valve 130.

The time when the intake valve 122 is opened may be varied with respect to piston TDC by an intake cam phaser 148. The time when the exhaust valve 130 is opened may be varied with respect to piston TDC by an exhaust cam phaser 150. A phaser actuator module 158 may control the intake cam phaser 148 and the exhaust cam phaser 150 based on signals from the ECM 114.

When implemented, variable valve lift timing and duration may also be controlled by the phaser actuator module 158. For example only, the phaser actuator module 158 may control intake and/or exhaust valves in two or more discrete valve lift states in variable valve lift systems.

The engine system 100 may include a turbocharger that includes a hot turbine 160-1 that is powered by hot exhaust gases flowing through the exhaust system 134. The turbocharger also includes a cold air compressor 160-2 that is driven by the turbine 160-1. The compressor 160-2 compresses air leading into the throttle valve 112. In various implementations, a supercharger (not shown), driven by the crankshaft, may compress air from the throttle valve 112 and deliver the compressed air to the intake manifold 110.

A wastegate 162 may allow exhaust to bypass the turbine 160-1, thereby reducing the boost (the amount of intake air compression) provided by the turbocharger. A boost actuator module 164 may control the boost of the turbocharger by controlling opening of the wastegate 162. In various implementations, two or more turbochargers may be implemented and may be controlled by the boost actuator module 164.

An air cooler (not shown) may transfer heat from the compressed air charge to a cooling medium, such as engine coolant or air. An air cooler that cools the compressed air charge using engine coolant may be referred to as an intercooler. An air cooler that cools the compressed air charge using air may be referred to as a charge air cooler. The compressed air charge may receive heat, for example, via compression and/or from components of the exhaust system 134. Although shown separated for purposes of illustration, the turbine 160-1 and the compressor 160-2 may be attached to each other, placing intake air in close proximity to hot exhaust.

The engine system 100 may include an exhaust gas recirculation (EGR) valve 170, which selectively redirects exhaust gas back to the intake manifold 110. The EGR valve 170 may be located upstream of the turbocharger's turbine 160-1. The EGR valve 170 may be controlled by an EGR actuator module (not shown) based on signals from the ECM 114.

An oil pump 174 pumps engine oil to various locations within the engine. For example, the oil pump 174 may pump engine oil to lubricate the pistons of the engine. Pressurized engine oil from the oil pump 174 may also be used, for example, by the phaser actuator module 158 to control phasing and the valve lift state and by the cylinder actuator module 120 to control activation and deactivation of cylinders. Engine oil from the oil pump 174 may also be used for one or more other reasons.

The oil pump 174 is a variable displacement oil pump. As such, the output of the oil pump 174 is variable. The output of the oil pump 174 may increase as the displacement of the oil pump 174 increases and vice versa. A pump actuator module 176 controls the output of the oil pump 174 as described further below.

A position of the crankshaft may be measured using a crankshaft position sensor 180. A rotational speed of the crankshaft (an engine speed) may be determined based on the crankshaft position. A temperature of the engine coolant may be measured using an engine coolant temperature (ECT) sensor 182. The ECT sensor 182 may be located within the engine 102 or at other locations where the coolant is circulated, such as a radiator (not shown).

A pressure within the intake manifold 110 may be measured using a manifold absolute pressure (MAP) sensor 184. In various implementations, engine vacuum, which is the difference between ambient air pressure and the pressure within the intake manifold 110, may be measured. A mass flow rate of air flowing into the intake manifold 110 may be measured using a mass air flow (MAF) sensor 186. In various implementations, the MAF sensor 186 may be located in a housing that also includes the throttle valve 112.

The throttle actuator module 116 may monitor the position of the throttle valve 112 using one or more throttle position sensors (TPS) 190. An ambient temperature of air being drawn into the engine 102 may be measured using an intake air temperature (IAT) sensor 192. The engine system 100 may also include one or more other sensors 193, such as an ambient humidity sensor, one or more knock sensors, a compressor outlet pressure sensor and/or a throttle inlet pressure sensor, a wastegate position sensor, an EGR position sensor, a voltage sensor, and/or one or more other suitable sensors. The ECM 114 may use signals from the sensors to make control decisions for the engine system 100.

The ECM 114 may communicate with a transmission control module 194 to coordinate shifting gears in a transmission (not shown). For example, the ECM 114 may reduce engine torque during a gear shift. The ECM 114 may communicate with a hybrid control module 196 to coordinate operation of the engine 102 and an electric motor 198.

The electric motor 198 may also function as a generator, and may be used to produce electrical energy for use by vehicle electrical systems and/or for storage in a battery. In various implementations, various functions of the ECM 114, the transmission control module 194, and the hybrid control module 196 may be integrated into one or more modules.

Figure 2:
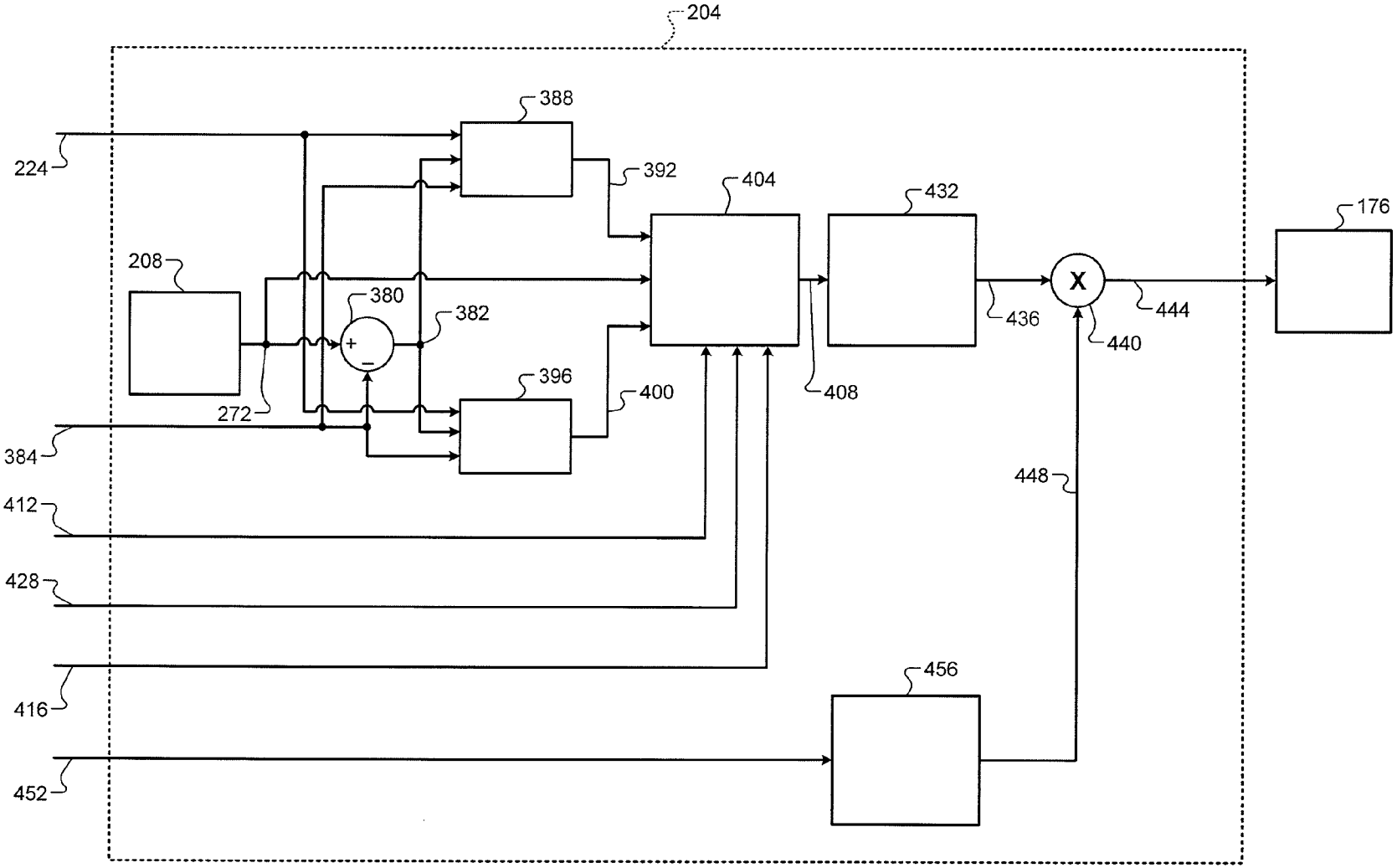
FIG. 2 is a functional block diagram of an example pump control module.
Figure 3:
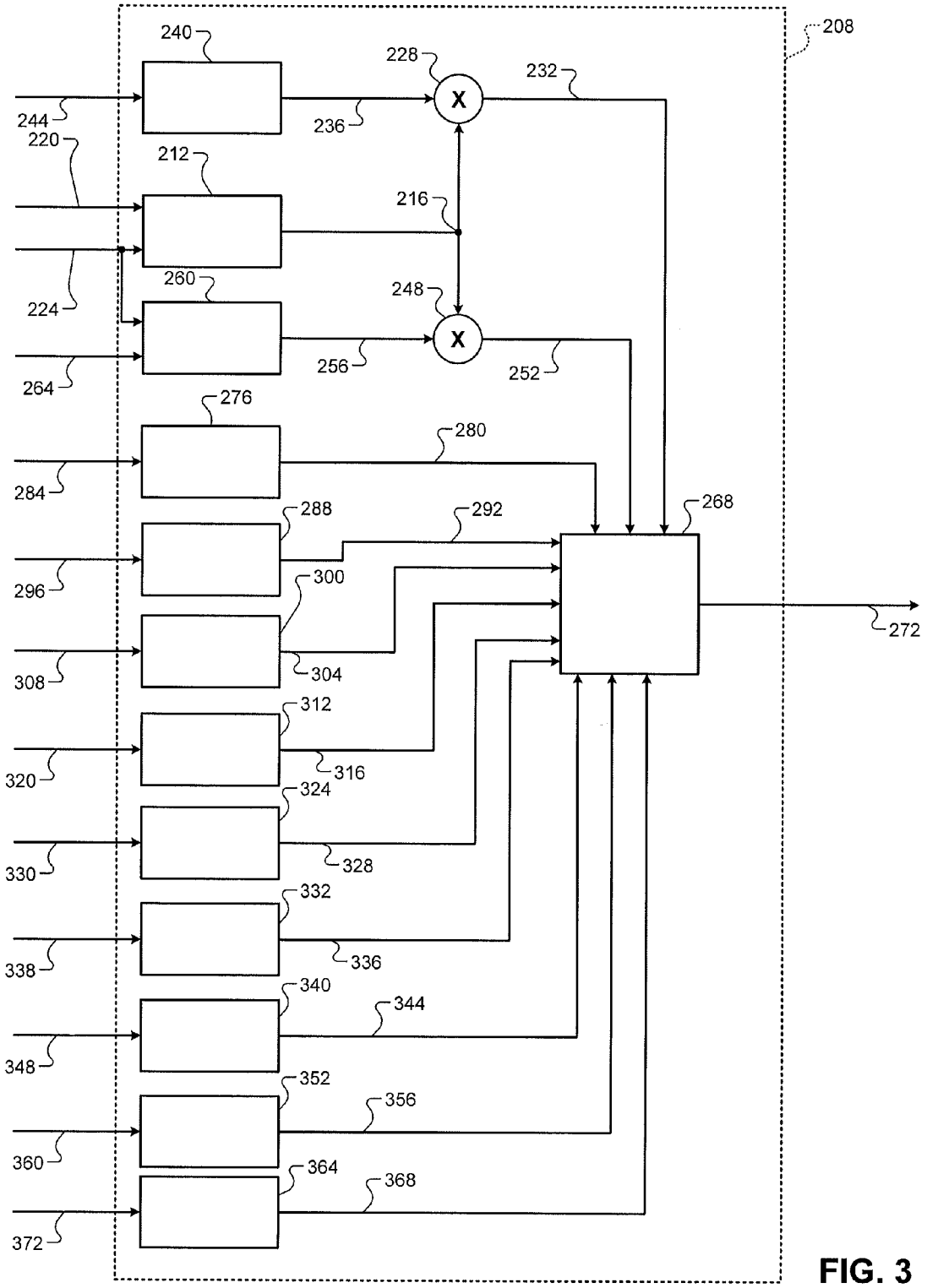
FIG. 3 is a functional block diagram of a target pressure module.

Referring now to FIG. 2, a functional block diagram of an example pump control module 204 is presented. The pump control module 204 may be implemented in the ECM 114, in another module, or independently. The pump control module 204 includes a first target pressure module 208. FIG. 3 includes a functional block diagram of an example implementation of the first target pressure module 208.

Referring now to FIG. 3, a minimum target module 212 determines a minimum target output pressure 216 for the oil pump 174 based on an engine speed 220 and an engine oil temperature 224. The minimum target output pressure 216 corresponds to a minimum possible output pressure of the oil pump 174 given the engine speed 220 and the engine oil temperature 224.

The minimum target module 212 may determine the minimum target output pressure 216, for example, using one of a function and a mapping that relates the engine speed 220 and the engine oil temperature 224 to the minimum target output pressure 216. The engine oil temperature 224 and the engine speed 220 may be measured using sensors or determined based on one or more other parameters. The engine speed 220 is related to a speed of the oil pump 174 and an oil pump speed may be determined based on the engine speed 220.

A first target module 228 generates a first target output pressure 232 of the oil pump 174 based on the minimum target output pressure 216 and a first adjustment 236. For example only, the first target module 228 may set the first target output pressure 232 equal to the minimum target output pressure 216 multiplied by the first adjustment 236. In this manner, the first target output pressure 232 will be set equal to the minimum target output pressure 216 when the first adjustment 236 is set to 1.

A first adjustment module 240 determines the first adjustment 236 based on a runtime period 244 of the engine 102. In the case of multiplication of the minimum target output pressure 216 and the first adjustment 236, the first adjustment 236 may be a value greater than or equal to 1. The engine runtime period 244 corresponds to a period between a time when a user last started the engine 102 and a present time.

The first adjustment module 240 may determine the first adjustment 236 using one of a function and mapping that relates the engine runtime period 244 to the first adjustment 236. For example only, the first adjustment module 240 may decrease the first adjustment 236 toward 1 as the engine runtime period 244 increases and vice versa. The first adjustment module 240 may set the first adjustment 236 to 1 when the engine runtime period 244 is greater than a predetermined period. For example only, the predetermined period may be approximately 5 seconds or another suitable period. The engine runtime period 244 may be reset to 0 each time the vehicle is shut down.

A second target module 248 generates a second target output pressure 252 of the oil pump 174 based on the minimum target output pressure 216 and a second adjustment 256. For example only, the second target module 248 may set the second target output pressure 252 equal to the minimum target output pressure 216 multiplied by the second adjustment 256. In this manner, the second target output pressure 252 will be set equal to the minimum target output pressure 216 when the second adjustment 256 is set to 1.

A second adjustment module 260 determines the second adjustment 256 based on the engine oil temperature 224 and an engine load 264. The second adjustment module 260 may determine the second adjustment 256 using one of a function and mapping that relates the engine oil temperature 224 and the engine load 264 to the second adjustment 256. For example only, the second adjustment module 260 may increase the second adjustment 256 above 1 as the engine load 264 increases and/or the engine oil temperature 224 increases. The second adjustment module 260 may decrease the second adjustment 256 toward or to 1 as the engine load 264 decreases and/or the engine oil temperature 224 decreases. The engine load 264 may correspond to a ratio of a current output (e.g., torque) of the engine 102 and a maximum output (e.g., torque) of the engine 102 and may be determined, for example, based on a MAF into the engine 102 and/or a MAP.

While the example of the first and second adjustments 236 and 256 being greater than or equal to 1 and multiplying the first and second adjustments 236 and 256 by the minimum target output pressure 216 are shown and has been discussed, the first and second target output pressures 232 and 252 may be determined in another suitable manner. For example only, the first and second adjustments 236 and 256 may be values that are greater than or equal to zero, and the first and second adjustments 236 and 256 may be summed with the minimum target output pressure 216 to generate the first and second target output pressures 232 and 252, respectively.

A selection module 268 sets a selected target output pressure 272 of the oil pump 174 based on the first target output pressure 232 and the second target output pressure 252. For example only, the selection module 268 may set the selected target output pressure 272 to the first target output pressure 232 when the first target output pressure 232 is greater than the second target output pressure 252. The selection module 268 may set the selected target output pressure 272 to the second target output pressure 252 when the second target output pressure 252 is greater than the first target output pressure 232. The selected target output pressure 272 is used to control the oil pump 174 when in closed loop, as discussed further below.

In various implementations, the first target pressure module 208 may also include one or more other target modules that generate one or more other target output pressures of the oil pump 174, respectively. The selection module 268 may set the selected target output pressure 272 to the highest one of the first target output pressure 232, the second target output pressure 252, and the one or more other target output pressures.

For example, the first target pressure module 208 may include a third target module 276 that generates a third target output pressure 280 of the oil pump 174 based on a remaining life 284 of the engine oil. The third target module 276 may, for example, increase the third target output pressure 280 as the remaining life 284 of the engine oil decreases and vice versa. The third target module 276 may determine the third target output pressure 280, for example, using one of a function and a mapping that relates the remaining life 284 of the engine oil to the third target output pressure 280.

Additionally or alternatively, the first target pressure module 208 may include a fourth target module 288 that generates a fourth target output pressure 292 of the oil pump 174 based on a level 296 of the engine oil. The oil level 296 corresponds to an amount of oil within the engine 102. The fourth target module 288 may determine the fourth target output pressure 292, for example, using one of a function and a mapping that relates the oil level 296 to the fourth target output pressure 292. The oil level 296 may be, for example, measured using an oil level sensor.

Additionally or alternatively, the first target pressure module 208 may include a fifth target module 300 that generates a fifth target output pressure 304 of the oil pump 174 based on a lateral acceleration 308 of the vehicle. The fifth target module 300 may determine the fifth target output pressure 304, for example, using one of a function and a mapping that relates the lateral acceleration 308 to the fifth target output pressure 304. The lateral acceleration 308 may be, for example, measured using a sensor.

Additionally or alternatively, the first target pressure module 208 may include a sixth target module 312 that generates a sixth target output pressure 316 of the oil pump 174 based on a pitch 320 of the vehicle. The sixth target module 312 may determine the sixth target output pressure 316, for example, using one of a function and a mapping that relates the vehicle pitch 320 to the sixth target output pressure 316. The vehicle pitch 320 may be, for example, measured using a sensor.

Additionally or alternatively, the first target pressure module 208 may include a seventh target module 324 that generates a seventh target output pressure 328 of the oil pump 174 based on a driving mode 330 of the vehicle. A user of the vehicle may select the driving mode, for example, using one or more buttons and/or switches within a passenger cabin of the vehicle. Example drives include a sport mode, an economy mode, a normal mode, and one or more other modes. The seventh target module 324 may determine the seventh target output pressure 328, for example, using one of a function and a mapping that relates the driving mode 330 to the seventh target output pressure 328.

Additionally or alternatively, the first target pressure module 208 may include an eighth target module 332 that generates an eighth target output pressure 336 of the oil pump 174 based on a cylinder deactivation state 338 of the engine 102. The cylinder deactivation state 338 may correspond to a command for a number of deactivated cylinders of the engine 102. The eighth target module 332 may determine the eighth target output pressure 336, for example, using one of a function and a mapping that relates the cylinder deactivation state 338 to the eighth target output pressure 336.

Additionally or alternatively, the first target pressure module 208 may include a ninth target module 340 that generates a ninth target output pressure 344 of the oil pump 174 based on commanded phasing 348 of the intake and/or exhaust camshafts. The ninth target module 340 may determine the ninth target output pressure 344, for example, using one of a function and a mapping that relates the commanded phasing 348 to the ninth target output pressure 344.

Additionally or alternatively, the first target pressure module 208 may include a tenth target module 352 that generates a tenth target output pressure 356 of the oil pump 174 based on an amount of aeration 360 of the engine oil. The tenth target module 352 may determine the tenth target output pressure 356, for example, using one of a function and a mapping that relates the aeration 360 of the engine oil to the tenth target output pressure 356. The amount of aeration 360 of the engine oil may be measured using a sensor or determined based on one or more other parameters.

Additionally or alternatively, the first target pressure module 208 may include an eleventh target module 364 that generates an eleventh target output pressure 368 of the oil pump 174 based on a valve lift state 372. The valve lift state 372 corresponds to the lift state of the valves of the engine 102. For example, the valve lift state 372 may correspond to the one of the discrete variable valve lift states that is presently in use. The eleventh target module 364 may determine the eleventh target output pressure 368, for example, using one of a function and a mapping that relates the valve lift state 372 to the eleventh target output pressure 368.

Referring back to FIG. 2, an error module 380 determines an error value 382 based on a difference between the selected target output pressure 272 and an output oil pressure 384 of the oil pump 174. For example, the error module 380 may set the error based on or equal to the selected target pressure minus the output oil pressure 384. The oil pressure 384 may be measured using an oil pressure sensor that measures a pressure output of the oil pump 174.

A proportional (P) module 388 generates a proportional pressure adjustment 392 based on the error value 382. The proportional module 388 may generate the proportional pressure adjustment 392, for example, using the relationship:

$$P_{ADJ}=K_P*\text{Error},$$

where $P_{ADJ}$ is the proportional pressure adjustment 392, $K_P$ is a proportional gain, and error is the error value 382. The proportional gain may be a variable value, and the proportional module 388 may determine the proportional gain, for example, based on the engine oil temperature 224 and the oil pressure 384. For example, the proportional module 388 may determine the proportional gain using one of a function and a mapping that relates the engine oil temperature 224 and the oil pressure 384 to the proportional gain. The proportional module 388 may, for example, increase the proportional gain as the oil pressure 384 increases and vice versa.

An integral (I) module 396 generates an integral pressure adjustment 400 based on the error value 382. The integral module 396 may generate the integral pressure adjustment 400 for example, using the relationship:

$$I_{ADJ}=K_I*\int\text{Error}*\partial t,$$

where $I_{ADJ}$ is the integral pressure adjustment 400, $K_I$ is an integral gain, and error is the error value 382. The integral gain may be a variable value, and the integral module 396 may determine the integral gain, for example, based on the engine oil temperature 224 and the oil pressure 384. For example, the integral module 396 may determine the integral gain using one of a function and a mapping that relates the engine oil temperature 224 and the oil pressure 384 to the integral gain. The integral module 396 may, for example, increase the integral gain as the oil pressure 384 increases and vice versa.

A second target pressure module 404 determines a final target output pressure 408 for the oil pump 174. Generally, the second target pressure module 404 sets the final target output pressure 408 based on the proportional pressure adjustment 392, the integral pressure adjustment 400, and the selected target output pressure 272. For example, the second target pressure module 404 may set the final target output pressure 408 equal to the selected target output pressure 272 plus the proportional pressure adjustment 392 and the integral pressure adjustment 400.

However, the second target pressure module 404 may set the final target output pressure 408 to values other than the sum of the selected target output pressure 272, the proportional pressure adjustment 392, and the integral pressure adjustment 400 under some circumstances. For example, the second target pressure module 404 may set the final target output pressure 408 to a predetermined maximum output pressure of the oil pump 174 when one or more faults are diagnosed. For example, the second target pressure module 404 may set the final target output pressure 408 to the predetermined maximum output pressure of the oil pump 174 when a fault is associated with the engine oil temperature sensor, the oil pressure sensor, and/or another component that may affect the accuracy of the selected target output pressure 272. The presence of one or more faults may be indicated by a fault signal 412.

Additionally or alternatively, the second target pressure module 404 may set the final target output pressure 408 to generate pulses in the oil pressure 384 when a pulse request 416 is active. The pulse request 416 may specify the number of pulses, the duration of the pulses, and/or the magnitude of the pulses. Generation of pulses in the oil pressure 384 may be requested, for example, when it has been determined that a valve that modulates the displacement of the oil pump 174 is stuck.

Additionally or alternatively, the second target pressure module 404 may maintain the final target output pressure 408 constant while a parameter is being learned. For example, the ECM 114 may learn a minimum torque of the engine 102 to maintain stable combustion under some circumstances. The second target pressure module 404 maintains the final target output pressure 408 constant while the minimum torque is being learned to provide constant conditions for learning the minimum torque. While only the example of learning the minimum torque is provided, other parameters may be learned. The learning of one or more parameters may be indicated by a learn signal 428.

The second target pressure module 404 may rate limit decreases in the final target output pressure 408. In other words, the second target pressure module 404 may limit the magnitude of decreases in the final target output pressure 408 to a predetermined maximum amount over each predetermined period.

A first duty cycle module 432 converts the final target output pressure 408 into a first target duty cycle 436 to apply to the oil pump 174 to control the displacement of the oil pump 174 and to achieve the final target output pressure 408. For example only, the first duty cycle module 432 may determine the first target duty cycle 436 using one of a function and a mapping that relates the final target output pressure 408 to the first target duty cycle 436.

A second duty cycle module 440 generates a second target duty cycle 444 to apply to the oil pump 174 based on the first target duty cycle 436 and a voltage adjustment 448. For example, the second duty cycle module 440 may set the second target duty cycle 444 to the first target duty cycle 436 multiplied by the voltage adjustment 448. As a voltage 452 applied to the oil pump 174 to control the displacement of the oil pump 174 affects the displacement of the oil pump 174, adjusting the first target duty cycle 436 based on the voltage adjustment 448 compensates for the voltage 452 and allows the final target output pressure 408 to be achieved. While the example of multiplication is provided, the voltage adjustment 448 may be summed with the first target duty cycle 436 or used to adjust the first target duty cycle 436 in another manner in various implementations. The voltage 452 may be a voltage, for example, of a battery of the vehicle.

A voltage adjustment module 456 determines the voltage adjustment 448 based on the voltage 452. For example, the voltage adjustment module 456 may determine the voltage adjustment 448 using one of a function and a mapping that relates the voltage 452 to the voltage adjustment 448.

Figure 4:
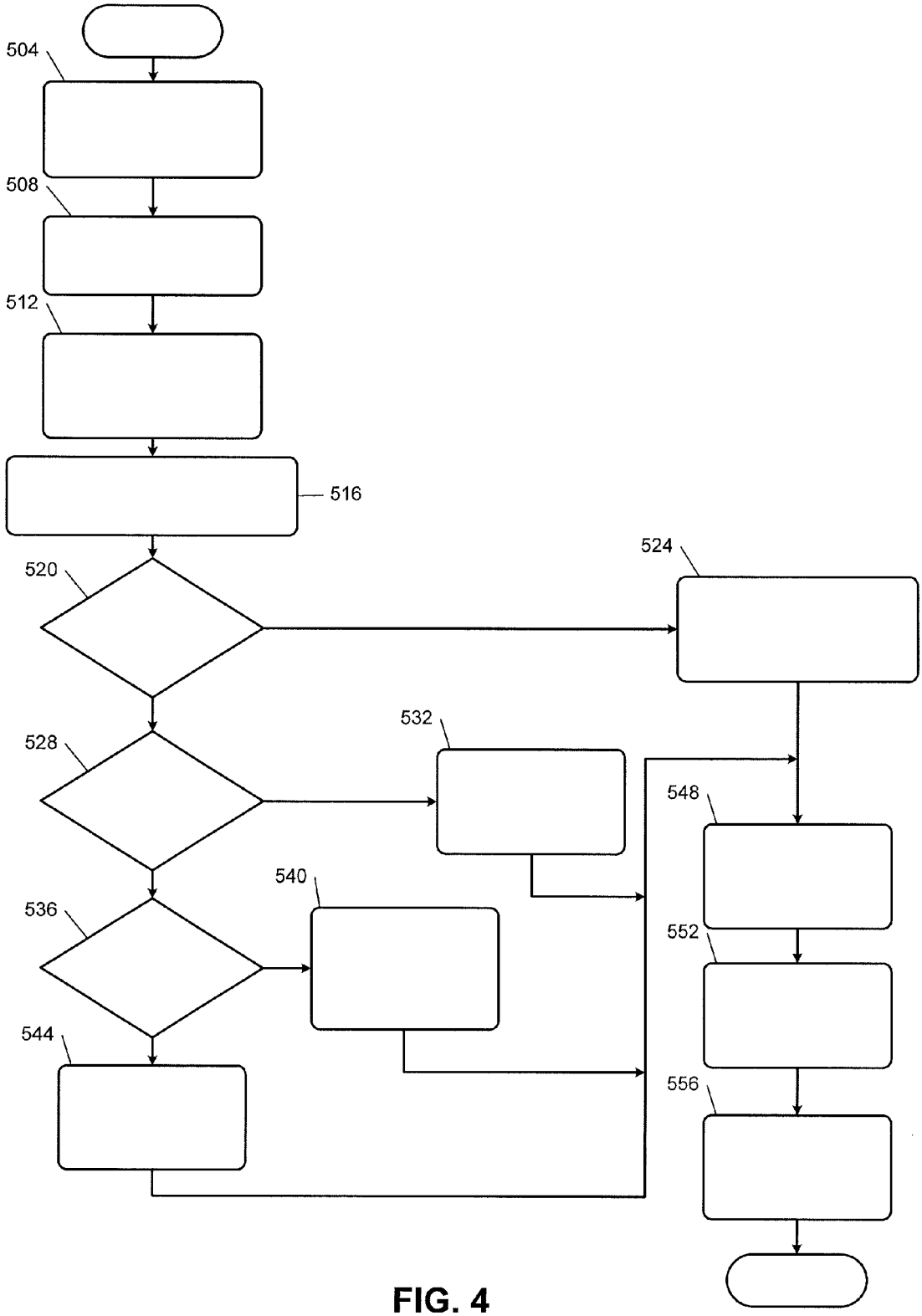
FIG. 4 is a flowchart depicting an example method of controlling an engine oil pump.

FIG. 4 is a flowchart depicting an example method of controlling the output of the oil pump 174. Referring now to FIG. 4, control may begin with 504 where the minimum target module 212 determines the minimum target output pressure 216 and the first and second adjustment modules 240 and 260 determine the first and second adjustments 236 and 256. The minimum target module 212 determines the minimum target output pressure 216 based on the engine speed 220 and the engine oil temperature 224. The first adjustment module 240 determines the first adjustment 236 based on the engine runtime period 244. The second adjustment module 260 determines the second adjustment 256 based on the engine load 264.

At 508, the first and second target modules 228 and 248 determine first and second target output pressures 232 and 252. The first target module 228 determines the first target output pressure 232 based on the first adjustment 236 and the minimum target output pressure 216. The second target module 248 determines the second target output pressure 252 based on the second adjustment 256 and the minimum target output pressure 216.

One or more other target pressure modules may also determine one or more other target output pressures, respectively, at 508. For example only, one or more of the third-eleventh target modules 276, 288, 300, 312, 324, 332, 340, 352, and 364 may determine the third-eleventh target output pressures 280, 292, 304, 360, 328, 336, 344, 356, at 368, respectively, as discussed above. The selection module 268 sets the selected target output pressure 272 for the oil pump 174 to or based on the highest one of the target output pressures at 512.

At 516, the error module 380 determines the error value 382 based on a difference between the selected target output pressure 272 and the oil pressure 384. The proportional and integral modules 388 and 396 also determine the proportional and integral pressure adjustments 392 and 400, respectively, at 516.

The second target pressure module 404 determines whether one or more faults are present that could affect the selected target output pressure 272 at 520. If 520 is true, the second target pressure module 404 sets the final target output pressure 408 to or based on the predetermined maximum output pressure of the oil pump 174 at 524, and control continues with 548, which is discussed further below. If 520 is false, control continues with 528.

At 528, the second target pressure module 404 may determine whether generation of pulses in the oil pressure 384 has been requested. If 528 is true, the second target pressure module 404 sets the final target output pressure 408 based on generating the requested pulses at 532, and control continues with 548. If 528 is false, control continues with 536.

The second target pressure module 404 determines whether learning of one or more parameters has been requested or if one or more parameters is being learned. If 536 is true, the second target pressure module 404 sets the final target output pressure 408 equal to the final target output pressure 408 from the last control loop at 540, and control continues with 548. If 536 is false, control continues with 544. The second target pressure module 404 sets the final target output pressure 408 to or based on the selected target output pressure 272 at 544, and control continues with 548. The second target pressure module 404 applies a rate limit when the decrease in the final target output pressure 408 from one control loop to the next control loop. In other words, the second target pressure module 404 decreases the final target output pressure 408 up to a predetermined maximum amount from one control loop to the next control loop.

At 548, the first duty cycle module 432 determines the first target duty cycle 436 for the oil pump 174. The first duty cycle module 432 may determine the first target duty cycle 436 using one of a function and a mapping that relates the final target output pressure 408 to the first target duty cycle 436. The voltage adjustment module 456 also determines the voltage adjustment 448 at 548. The voltage adjustment module 456 determines the voltage adjustment 448 based on the voltage 452.

The second duty cycle module 440 determines the second target duty cycle 444 at 552. The second duty cycle module 440 determines the second target duty cycle 444 based on the first target duty cycle 436 and the voltage adjustment 448, such as by multiplying the voltage adjustment 448 with the first target duty cycle 436. At 556, the pump actuator module 176 applies signals to the oil pump 174 at the second target duty cycle 444 to achieve the final target output pressure 408. While FIG. 4 is shown as ending after 556, the example of FIG. 4 includes one control loop and control loops may be executed at a predetermined rate.

The foregoing description is merely illustrative in nature and is in no way intended to limit the disclosure, its application, or uses. The broad teachings of the disclosure can be implemented in a variety of forms. Therefore, while this disclosure includes particular examples, the true scope of the disclosure should not be so limited since other modifications will become apparent upon a study of the drawings, the specification, and the following claims. As used herein, the phrase at least one of A, B, and C should be construed to mean a logical (A OR B OR C), using a non-exclusive logical OR, and should not be construed to mean "at least one of A, at least one of B, and at least one of C." It should be understood that one or more steps within a method may be executed in different order (or concurrently) without altering the principles of the present disclosure.

In this application, including the definitions below, the term 'module' or the term 'controller' may be replaced with the term 'circuit.' The term 'module' may refer to, be part of, or include: an Application Specific Integrated Circuit (ASIC); a digital, analog, or mixed analog/digital discrete circuit; a digital, analog, or mixed analog/digital integrated circuit; a combinational logic circuit; a field programmable gate array (FPGA); a processor circuit (shared, dedicated, or group) that executes code; a memory circuit (shared, dedicated, or group) that stores code executed by the processor circuit; other suitable hardware components that provide the described functionality; or a combination of some or all of the above, such as in a system-on-chip.

The module may include one or more interface circuits. In some examples, the interface circuits may include wired or wireless interfaces that are connected to a local area network (LAN), the Internet, a wide area network (WAN), or combinations thereof. The functionality of any given module of the present disclosure may be distributed among multiple modules that are connected via interface circuits. For example, multiple modules may allow load balancing. In a further example, a server (also known as remote, or cloud) module may accomplish some functionality on behalf of a client module.

The term code, as used above, may include software, firmware, and/or microcode, and may refer to programs, routines, functions, classes, data structures, and/or objects. The term shared processor circuit encompasses a single processor circuit that executes some or all code from multiple modules. The term group processor circuit encompasses a processor circuit that, in combination with additional processor circuits, executes some or all code from one or more modules. References to multiple processor circuits encompass multiple processor circuits on discrete dies, multiple processor circuits on a single die, multiple cores of a single processor circuit, multiple threads of a single processor circuit, or a combination of the above. The term shared memory circuit encompasses a single memory circuit that stores some or all code from multiple modules. The term group memory circuit encompasses a memory circuit that, in combination with additional memories, stores some or all code from one or more modules.

The term memory circuit is a subset of the term computer-readable medium. The term computer-readable medium, as used herein, does not encompass transitory electrical or electromagnetic signals propagating through a medium (such as on a carrier wave); the term computer-readable medium may therefore be considered tangible and non-transitory. Non-limiting examples of a non-transitory, tangible computer-readable medium include nonvolatile memory circuits (such as a flash memory circuit or a mask read-only memory circuit), volatile memory circuits (such as a static random access memory circuit and a dynamic random access memory circuit), and secondary storage, such as magnetic storage (such as magnetic tape or hard disk drive) and optical storage.

The apparatuses and methods described in this application may be partially or fully implemented by a special purpose computer created by configuring a general purpose computer to execute one or more particular functions embodied in computer programs. The computer programs include processor-executable instructions that are stored on at least one non-transitory, tangible computer-readable medium. The computer programs may also include or rely on stored data. The computer programs may include a basic input/output system (BIOS) that interacts with hardware of the special purpose computer, device drivers that interact with particular devices of the special purpose computer, one or more operating systems, user applications, background services and applications, etc.

The computer programs may include: (i) assembly code; (ii) object code generated from source code by a compiler; (iii) source code for execution by an interpreter; (iv) source code for compilation and execution by a just-in-time compiler, (v) descriptive text for parsing, such as HTML (hypertext markup language) or XML (extensible markup language), etc. As examples only, source code may be written in C, C++, C#, Objective-C, Haskell, Go, SQL, Lisp, Java®, ASP, Perl, Javascript®, HTML5, Ada, ASP (active server pages), Perl, Scala, Erlang, Ruby, Flash®, Visual Basic®, Lua, or Python®.

None of the elements recited in the claims is intended to be a means-plus-function element within the meaning of 35 U.S.C. §112(f) unless an element is expressly recited using the phrase "means for", or in the case of a method claim using the phrases "operation for" or "step for".

What is claimed is:

1. An engine oil pump control system for a vehicle, comprising:

a first target module that determines a first target output pressure of an engine oil pump based on a speed of the engine oil pump and an oil temperature;

a second target module that, based on a runtime period of an engine, sets a second target output pressure of the engine oil pump to one of greater than and equal to the first target output pressure;

a third target module that, based on an engine load, sets a third target output pressure of the engine oil pump to one of greater than and equal to the first target output pressure; and a selection module that selects one of the second and third target output pressures, that sets a selected target output pressure based on the selected one of the second and third target output pressures, and that controls displacement of the engine oil pump based on the selected target output pressure.

2. The engine oil pump control system of claim 1 further comprising an adjustment module that determines an adjustment value based on the runtime period of the engine, wherein the second target module determines the second target output pressure of the engine oil pump as a function of the first target output pressure and the adjustment value.

3. The engine oil pump control system of claim 1 further comprising an adjustment module that determines an adjustment value based on the engine load, wherein the second target module determines the second target output pressure of the engine oil pump as a function of the first target output pressure and the adjustment value.

4. The engine oil pump control system of claim 1 wherein the selection module selects the second target output pressure when the second target output pressure is greater than the third target output pressure.

5. The engine oil pump control system of claim 4 wherein the selection module selects the third target output pressure when the third target output pressure is greater than the second target output pressure.

6. The engine oil pump control system of claim 1 further comprising:

a proportional module that determines a proportional pressure adjustment based on a proportional gain value and a difference between an engine oil pressure and the selected target output pressure;

an integral module that determines an integral pressure adjustment based on an integral gain value and the difference between the engine oil pressure and the selected target output pressure; and a target duty cycle module that selectively sets a target duty cycle for controlling the displacement of the engine oil pump based on a sum of the selected target output pressure, the proportional pressure adjustment, and the integral pressure adjustment.

7. The engine oil pump control system of claim 6 wherein the proportional module determines the proportional gain value based on the engine oil pressure.

8. The engine oil pump control system of claim 7 wherein the proportional module determines the proportional gain value further based on an engine oil temperature.

9. The engine oil pump control system of claim 6 wherein the integral module determines the integral gain value based on the engine oil pressure.

10. The engine oil pump control system of claim 9 wherein the integral module determines the integral gain value further based on an engine oil temperature.

11. An engine oil pump control method comprising:

determining a first target output pressure of an engine oil pump based on an engine speed and an oil temperature;

based on a runtime period of an engine, setting a second target output pressure of the engine oil pump to one of greater than and equal to the first target output pressure;

based on an engine load, setting a third target output pressure of the engine oil pump to one of greater than and equal to the first target output pressure;

selecting one of the second and third target output pressures;

setting a selected target output pressure based on the selected one of the second and third target output pressures; and controlling displacement of the engine oil pump based on the selected target output pressure.

12. The engine oil pump control method of claim 11 further comprising:

determining an adjustment value based on the runtime period of the engine; and determining the second target output pressure of the engine oil pump as a function of the first target output pressure and the adjustment value.

13. The engine oil pump control method of claim 11 further comprising:

determining an adjustment value based on the engine load; and determining the second target output pressure of the engine oil pump as a function of the first target output pressure and the adjustment value.

14. The engine oil pump control method of claim 11 further comprising selecting the second target output pressure when the second target output pressure is greater than the third target output pressure.

15. The engine oil pump control method of claim 14 further comprising selecting the third target output pressure when the third target output pressure is greater than the second target output pressure.

16. The engine oil pump control method of claim 11 further comprising:

determining a proportional pressure adjustment based on a proportional gain value and a difference between an engine oil pressure and the selected target output pressure;

determining an integral pressure adjustment based on an integral gain value and the difference between the engine oil pressure and the selected target output pressure; and selectively setting a target duty cycle for controlling the displacement of the engine oil pump based on a sum of the selected target output pressure, the proportional pressure adjustment, and the integral pressure adjustment.

17. The engine oil pump control method of claim 16 further comprising determining the proportional gain value based on the engine oil pressure.

18. The engine oil pump control method of claim 17 further comprising determining the proportional gain value further based on an engine oil temperature.

19. The engine oil pump control method of claim 16 further comprising determining the integral gain value based on the engine oil pressure.

20. The engine oil pump control method of claim 19 further comprising determining the integral gain value further based on an engine oil temperature.

* * * * *